United States Patent [19]

Johnson

[11] 4,131,076

[45] Dec. 26, 1978

[54] SEWING MACHINE WORK FEEDING MECHANISM

[75] Inventor: Ralph E. Johnson, Convent Station, N.J.

[73] Assignee: The Singer Company, New York, N.Y.

[21] Appl. No.: 851,073

[22] Filed: Nov. 14, 1977

[51] Int. Cl.[2] ..... D05B 15/02

[52] U.S. Cl. ..... 112/210; 112/215

[58] Field of Search ..... 112/209, 210, 215

[56] References Cited

U.S. PATENT DOCUMENTS

| | | | |
|---|---|---|---|
| 1,312,823 | 8/1919 | Berger, Jr. | 112/209 |
| 2,931,329 | 4/1960 | Johnson | 112/210 |
| 3,015,290 | 1/1962 | Hale | 112/210 |
| 3,420,200 | 1/1969 | Johnson | 112/258 |
| 3,742,881 | 7/1973 | Heine et al. | 112/210 |

*Primary Examiner*—Wm. Carter Reynolds

*Attorney, Agent, or Firm*—William V. Ebs; Robert E. Smith; Edward L. Bell

[57] ABSTRACT

A sewing machine is provided with a stitch regulator and mechanism operably connecting such stitch regulator with feed advancing and feed lifting mechanism enabling an operator when adjusting the stitch regulator to simultaneously alter the timing of the operation of both the feed advancing and feed lifting mechanisms and so maintain a desired phase relationship between them.

4 Claims, 11 Drawing Figures

SEWING MACHINE WORK FEEDING MECHANISM

BACKGROUND OF THE INVENTION

1. Field of the Invention

The invention relates to sewing machines and more particularly is directed to feed controlling mechanism for sewing machines.

2. Description of the Prior Art

Sewing machines are conventionally provided with mechanism for moving a feed dog through work feeding and return strokes, and for imparting relative vertical movement to the feed dog and throat plate of the machine so as to expose the feed dog during feeding strokes above the throat plate. It is also known to provide a sewing machine with stitch regulating means enabling an operator to vary the length of the feed stroke to be imparted to the feed dog during its operation. One example of a machine so equipped is shown and described in U.S. Pat. No. 3,420,200 of R. E. Johnson for Modular Sewing Machines issued Jan. 7, 1969.

SUMMARY OF THE INVENTION

In accordance with the invention, feed advancing mechanism, feed lifting mechanism and a stitch regulator are interconnected in an improved manner enabling an operator to simultaneously adjust the timing of the operation of the feed advancing and the feed lifting mechanisms when selecting a stitch length with the stitch regulator. The feed advancing mechanism, feed lifting mechanism and stitch regulator are interconnected through a single eccentric, and the resulting construction is less expensive as well as less subject to vibration than prior art feed control means such as the feed control means of the aforementioned U.S. Patent and other known control means including a stitch regulator in association with a rotatable constant breadth cam and yoke which is operably connected to a feed dog.

DESCRIPTION OF THE PREFERRED EMBODIMENT

Figure 1:
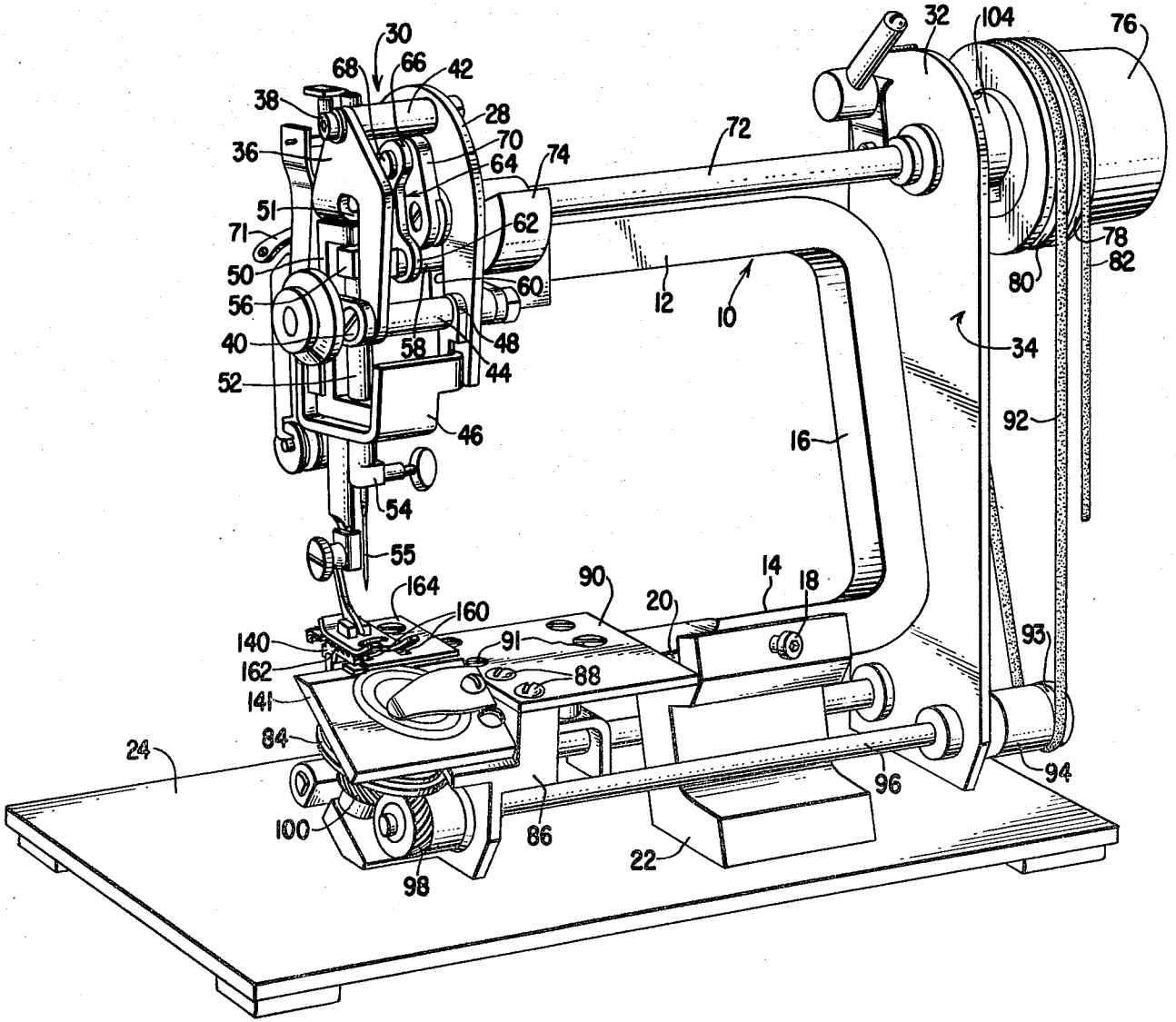
FIG. 1 is a front perspective view of a sewing machine according to the invention.
Figure 2:
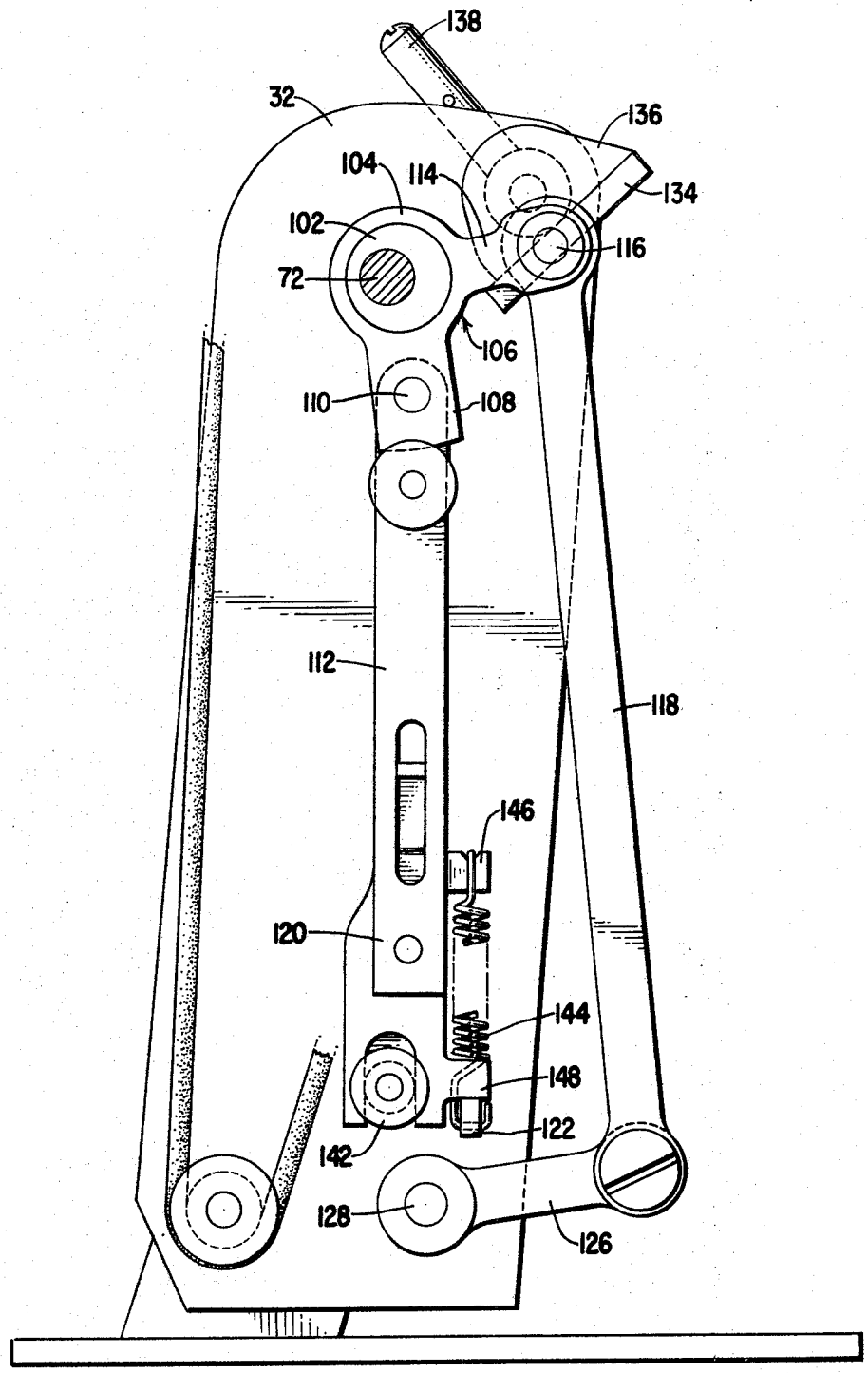
FIG. 2 is a right hand elevational view of the sewing machine of FIG. 1 with the hand wheel removed.
Figure 3:
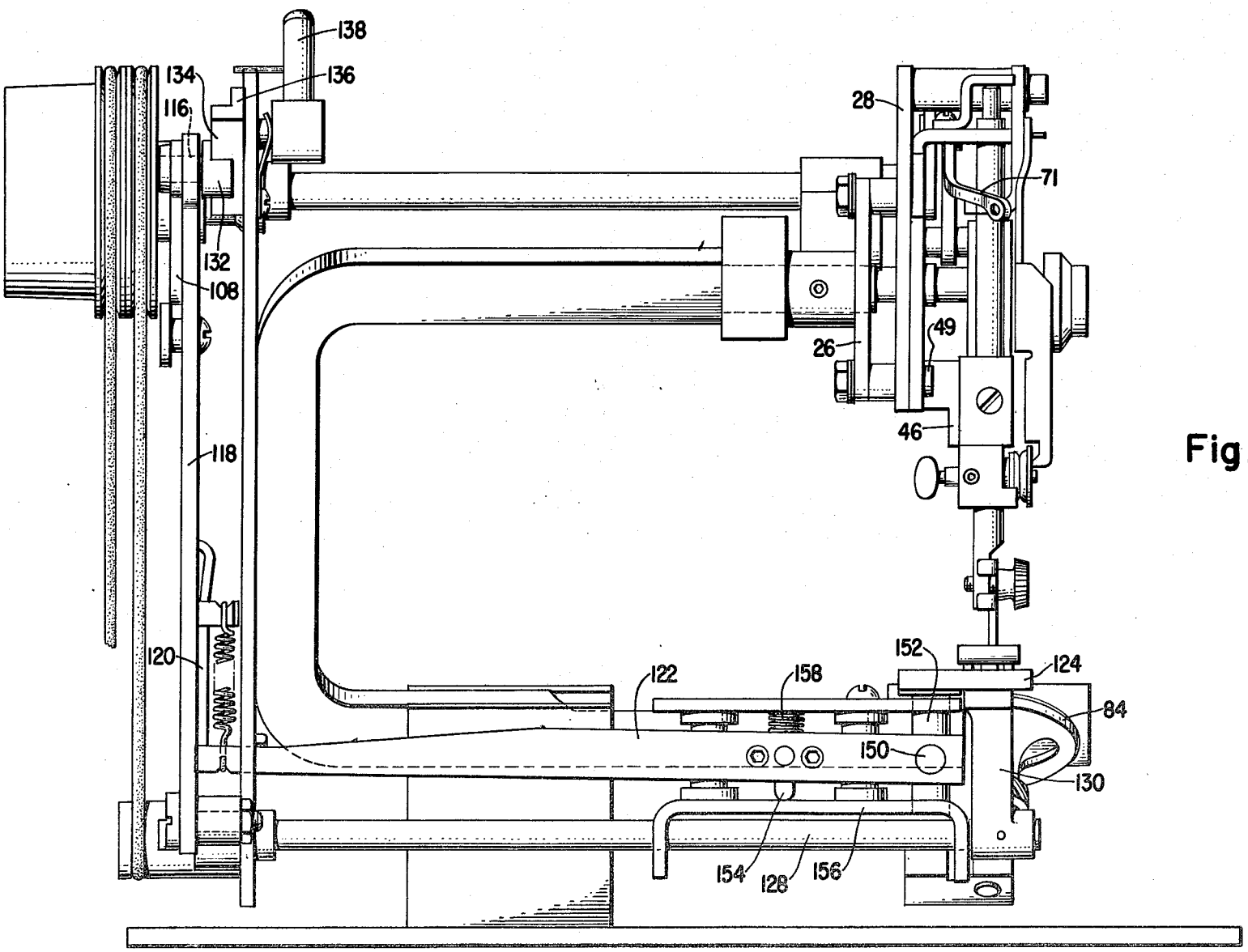
FIG. 3 is a rear elevational view of the sewing machine of FIG. 1.

Referring to the drawings and in particular to FIGS. 1, 2 and 3, reference character 10 designates a C-shaped frame including a pair of substantially parallel extremities 12 and 14 joined by a connecting portion 16. The lower extremity 14 is secured by a set screw 18 within the channel 20 of a block 22 that is fixedly mounted on a platform 24, and the upper extremity 12 is secured to a plate 26 which is in turn affixed to a support plate 28 of a needle module 30. Connecting portion 16 of the frame is secured to the support plate 32 of a control module 34.

A yoke 36 is secured by screws 38 and 40 to support plate 28 at a distance therefrom established by spacers 42 and 44. A bracket 46 is also secured to plate 28 at 48 and 49. A needle bar gate 50 located between the bracket 46 and a flanged portion 51 of yoke 36 slidably supports a needle bar 52. The needle bar extends through bearings in the gate 50 and holes in both the flanged portion 51 of yoke 36 and in bracket 46. As shown the needle bar includes at its lower extremity a needle bar clamp 54 in which an eye-pointed thread carrying sewing machine needle 55 is secured. The needle bar 52 is secured to a fitting 56 having one end of stud shaft 58 pivotally mounted therein; the other end of the stud shaft being slidable in a slot 60 in support plate 28. The stud shaft 58 is affixed to one end 62 of a link 64 having its other end 66 pivotally mounted at 68 to a crank 70. A thread take-up arm 71 is integral with the crank connected end 66 of link 64.

An arm shaft 72 having a balancing counterweight 74 thereon connects at one end with the crank 70 and at its other end with a hand wheel 76 which is formed with annular belt grooves 78 and 80. The belt groove 78 accommodates a drive belt 82 from a suitable source of power (not shown) such as a drive pulley on an electric motor which may be supported on plate 32. Rotation of the hand wheel upon the application of power to the drive belt 82 results in the rotation of arm shaft 72 and the crank 70 which in turn acts through link 64, stud shaft 58 and fitting 56 to produce reciprocating motion of the needle bar 52 and the needle 55 attached thereto.

A rotary loop taker 84 is provided to cooperate with needle 55 in the formation of stitches. Such loop taker, which may be of any known or conventional type suitable for the formation of either chain or lock stitches, is carried in a frame 86 which is secured by screws 88 to a plate 90 that is affixed at 91 to the lower extremity 14 of frame 10. A driving connection extends to the loop taker 84 from hand wheel 76 and includes a belt 92 engaged both in groove 80 in wheel 76 and a groove 93 in a wheel 94 on a shaft 96. Rotation of hand wheel 76 causes the belt 92 to drive wheel 94 and the shaft 96 which acts through a gear 98 on the shaft and a meshing gear 100 to drive the loop taker.

In accordance with the invention arm shaft 72 is provided with a single eccentric 102. Such eccentric rotates with the arm shaft within the surrounding housing 104 of a pitman 106 having an arm 108 pivotally connected at 110 to a link associated with feed lifting mechanism, and an arm 114 pivotally connected through a stub shaft 116 to another link 118 associated with feed advancing mechanism. The feed lifting mechanism includes in addition to the link 112, other links 120 and 122, and a throat plate 124; and the feed advancing mechanism includes in addition to the link 118, another link 126, a shaft 128 and a feed dog arm 130. The stub shaft 116 pivotally connecting arm 114 of pitman 106 to link 118 includes a slotted boss 132 at one end slidably mounted on the flange 134 of a stitch regulator 136 which is pivotally mounted in plate 32 and which can be selectively positioned by an operator with handle 138.

Rotation of eccentric 102 by handwheel 76 results in boss 132 and the axis of stub shaft 116 being moved to and fro along flange 134 of stitch regulator 136. Arm 114 of pitman 106 acts through link 118 causing link 126 to be pivoted reciprocally through an angle dependent upon the position of the stitch regulator 136. Link 126 moves shaft 128, and the shaft reciprocates link 130 and a feed dog 140 which floats on the link and is maintained horizontal by engagement with a plate 141 secured to frame 86.

As the eccentric 102 rotates, link 112 and the link 120 which is affixed to link 112 are moved up and down and pivotally above a grooved pin 142 secured to plate 32. A spring 144 having one end connected to an arm 146 of link 120 and the other end connected to a link 122 holds one end of the link 122 against an abutment 148 on link 120. The other end of link 122 pivotally connects at 150 with a vertically slidable post 152 having its upper end secured to throat plate 124. Between its ends, link 122 is secured to a pin 154 which is maintained in contact with a bracket 156 by a spring 158 that bears against link 122. As links 112 and 120 are moved by the operation of eccentric 102 link 122 is caused to rock on pin 154 and throat plate 124 is vertically reciprocated by post 152. The throat plate includes slots 160 in alignment with feed dog teeth 162 which alternately appear above and below the planar surface 164 of the throat plate as the throat plate rises and falls.

Each revolution of shaft 72 and therefore of eccentric 102 results in a complete cyclic movement of feed dog 140, throat plate 124, needle bar 52 and thread takeup 71, such operations being relatively phased for trouble free sewing by means of a suitable arrangement and proportionment of the driving parts. The horizontal distance through which the feed dog 140 is caused to move and the length of stitch produced as a result is predetermined by an operator setting stitch regulator 136 in a selected position with handle 138.

Figure 4A:
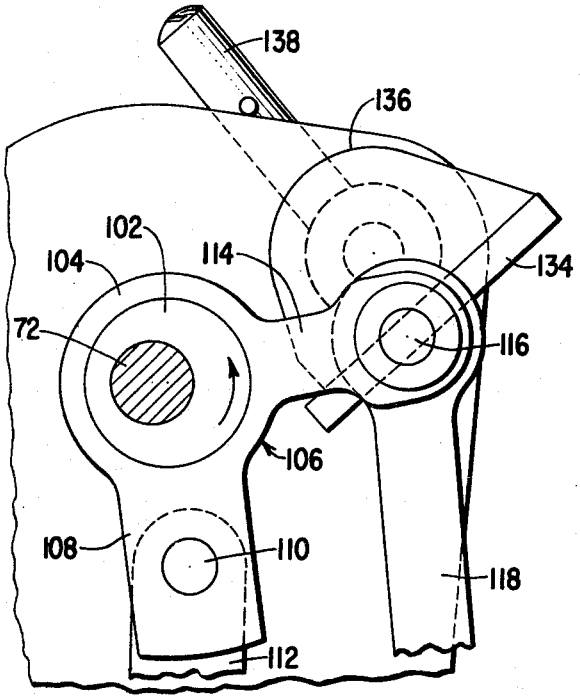
FIGS. 4A, 5A, 6A, and 7A are fragmentary right hand elevational views illustrating the operation of the stitch regulator and associated mechanism of the sewing machine of FIG. 1.
Figure 5A:
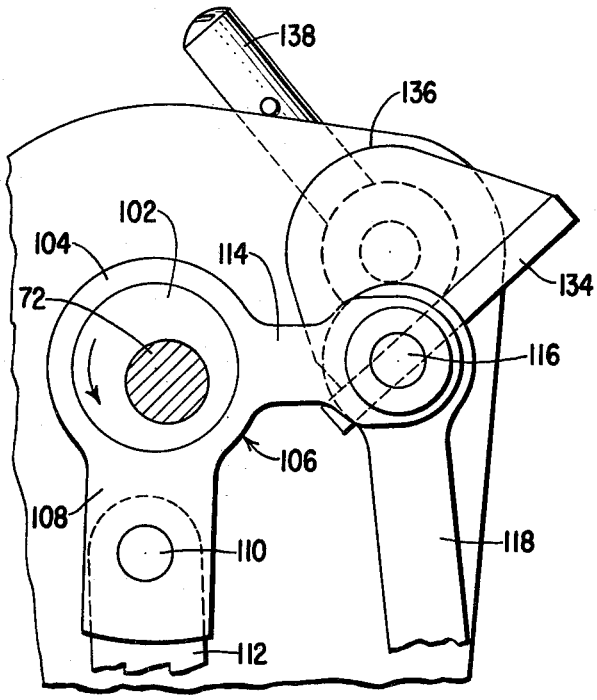
Figure 4B:
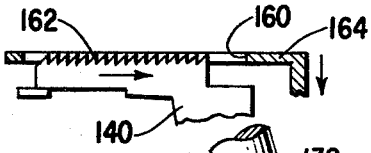
FIGS. 4B, 5B, 6B, and 7B are fragmentary side elevational views partially in section illustrating the relative locations of a feed dog and throat plate for positions of the stitch regulator and associated mechanism illustrated in FIGS. 4A, 5A, 6A and 7A respectively.
Figure 5B:
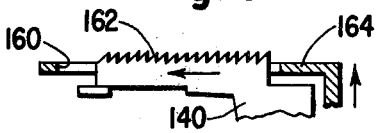
Figure 6A:
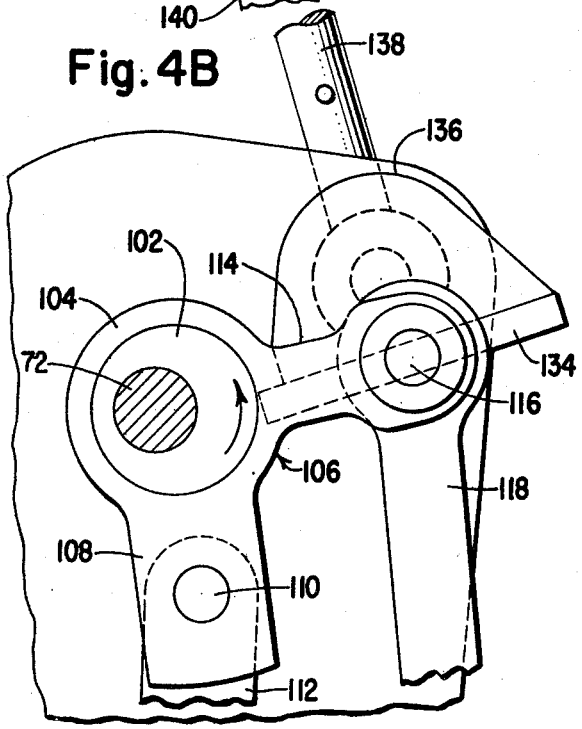
Figure 7A:
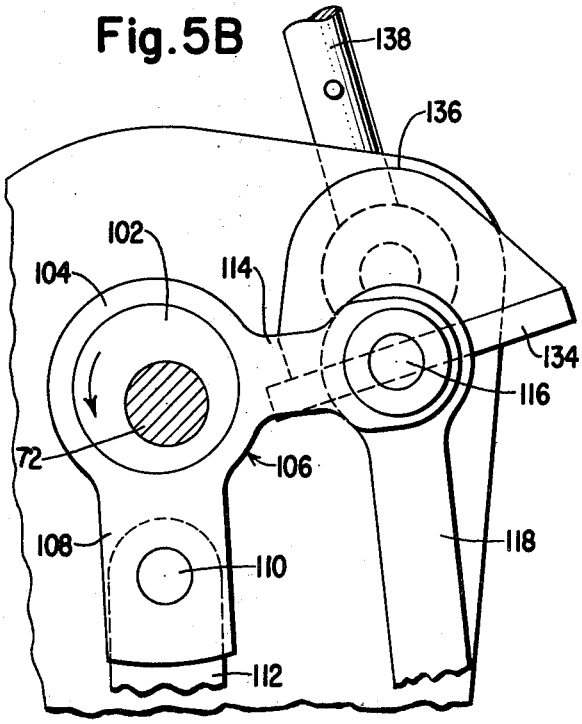
Figure 6B:
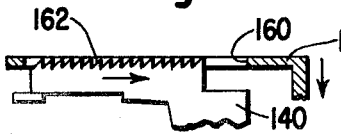
Figure 7B:
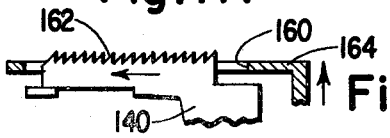

In FIGS. 4A and 5A the stitch regulator is shown in a position resulting in a long stitch. The eccentric 102 in FIG. 4A is in the position corresponding to one extreme position (FIG. 4B position) of feed dog 140 for the long stitch, and in FIG. 5A is in the position corresponding to the other extreme position (FIG. 5B position) of the feed dog for such stitch. In FIGS. 6A and 7A the stitch rgulator is shown in a position for producing a shorter stitch. The eccentric positions in FIGS. 6A and 7A correspond to the extreme positions of the feed dog (FIGS. 6B and 7B respectively) for the shorter stitch.

When the stitch regulator 136 is moved as between the 4A and 6A positions to change stitch length it moves the pitman 106 with respect to the eccentric 102 to simultaneously alter the timing of the operation of the feed dog and throat plate with respect to rotation of the eccentric thereby enabling the feed dog teeth 162 to be maintained above the planar surface of the throat plate throughout movements of the feed dog in the forward feeding direction (indicated in FIG. 4B) regardless of the selected stitch length. If the stitch regulator 136 is positioned to reverse the slope of flange 134, the feed dog teeth are caused to appear above the throat plate during reverse movements of the feed dog thereby enabling reverse stitching to be performed on the machine. Stitch length is determined according to the reversed position of the stitch regulator and the interconnection through the eccentric 102 between the feed advancing and feed lifting mechanisms maintains the feed dog teeth above the throat plate throughout reverse feed regardless of the chosen stitch length.

Although a preferred embodiment of the invention has been shown and described it is to be understood that other embodiments are possible and that various changes and modifications may be made by one skilled in the art in the construction herein set forth without departing from the spirit and scope of the invention as set forth in the annexed claims.

Having thus set forth the nature of the invention, what is claimed herein is:

1. In cyclically operated work feed controlling mechanism for a sewing machine the combination comprising a feed dog shiftable through slots in a throat plate on said sewing machine, feed advancing mechanism for imparting alternate work feed and return strokes to said feed dog, feed lifting mechanism for imparting relative vertical movement to said feed dog and said throat plate to expose said feed dog above said throat plate during the feed strokes thereof, a stitch length regulator for selecting stitch length by selectively setting the magnitude of feed stroke imparted to said feed dog by said feed advancing mechanism, and mechanism operatively interconnecting the stitch length regulator, feed advancing mechanism and feed lifting mechanism for altering the timing of the operation of both the feed advancing mechanism and feed lifting mechanism when the stitch regulator is moved to change stitch length whereby the feed dog is caused to project above the throat plate substantially throughout the length of feeding strokes regardless of selected stitch length.

2. The combination of claim 1 wherein the interconnecting mechanism includes an eccentric which serves as a driving member for both the feed advancing and the feed lifting mechanisms.

3. The combination of claim 2 wherein the interconnecting mechanism includes a pitman having a housing surrounding said eccentric, the pitman also including a first arm connected to the stitch regulator and feed advancing mechanism and a second arm connected to the feed lifting mechanism.

4. The combination of claim 3 wherein the feed advancing mechanism extends from said first arm of the pitman to the feed dog and the feed lifting mechanism extends from said second arm to the throat plate.

* * * * *